United States Patent [19]

Labbe

[11] 4,256,125

[45] Mar. 17, 1981

[54] CIGARETTE MAKING MACHINE

[75] Inventor: Francis A. M. Labbe, Neuilly sur Seine, France

[73] Assignee: Molins Limited, England

[21] Appl. No.: 46,920

[22] Filed: Jun. 8, 1979

[30] Foreign Application Priority Data

Jun. 13, 1978 [GB] United Kingdom ..... 26816/78

[51] Int. Cl.[3] ..... A24C 5/18

[52] U.S. Cl. ..... 131/66 R; 131/84 B; 131/84 C

[58] Field of Search ..... 131/84 B, 84 C, 84 A, 131/84 R, 110, 108, 66

[56] References Cited

U.S. PATENT DOCUMENTS

| | | | |
|---|---|---|---|
| 3,810,475 | 5/1974 | Labbe | 131/84 B |
| 3,850,177 | 11/1974 | Labbe | 131/66 R |
| 4,041,958 | 8/1977 | Wahle et al. | 131/84 B |

FOREIGN PATENT DOCUMENTS

| | | | |
|---|---|---|---|
| 1340201 | 12/1973 | United Kingdom | 131/84 B |

*Primary Examiner*—Stephen C. Pellegrino
*Attorney, Agent, or Firm*—Craig and Antonelli

[57] ABSTRACT

A cigarette making machine comprises an air previous band, a channel through which tobacco is showered towards the band with the aid of an air stream to form a cigarette filler stream on the band, the air stream being induced at least partly by suction acting through the band to hold the tobacco against the band, whereby there is also suction pressure in the channel at the end adjacent to the band, characterized by a partly-tubular casing which covers the cigarette filler stream as it leaves the shower channel, and inclined air inlets which are arranged to introduce air streams into the part-tubular casing direction having components in the direction of the cigarette filler stream.

6 Claims, 4 Drawing Figures

CIGARETTE MAKING MACHINE

Our British patent specification No. 1,340,201 describes an invention whereby, amongst other things, the flap seal commonly used in the Molins Mark 8 and Mark 9 cigarette making machines can be obviated. The arrangement described in that specification involves the use of a suction pipe for removing discard tobacco from below the trimming device. Partly as a result of that suction pipe, suction pressure is maintained in the space below the cigarette filler stream and downstream of the chimney at a level greater than the suction pressure at the upper end of the chimney; this ensures that air flows from the chimney into that suction space, rather than in the reverse direction.

It is not always convenient or desirable to use a suction pipe for conveying away the discard tobacco. The Mark 8 and Mark 9 cigarette making machines conventionally use a conveying screw, and it is some cases convenient to go on doing so. This invention is particularly concerned with an arrangement which avoids the need for a flap seal but allows the continued use of the conveying screw or of some other mechanical conveying device for removing discard tobacco.

According to this invention a cigarette making machine comprises an air-pervious band, a channel through which tobacco is showered towards the band with the aid of an air stream to form a cigarette filler stream on the band, the air stream being induced at least partly by suction acting through the band to hold the tobacco against the band, whereby there is also suction pressure in the channel at the end adjacent to the band, characterised by a partly-tubular casing which covers the cigarette filler stream as it leaves the shower channel, and inclined air inlets which are arranged to introduce air streams into the part-tubular casing in directions having components in the direction of movement of the cigarette filler stream.

This arrangement allows the flap seal to be removed since the inclined air streams prevent or substantially prevent any reverse flow of air along the filler stream.

A preferred arrangement according to this invention is one in which the inside of the casing is arranged to have a pressure below atmospheric, and in which the air inlets draw in air from the atmosphere. However, as an alternative the inside of the casing may be at approximately atmospheric pressure, and air may be blown in through the air inlets from a manifold containing air at a pressure slightly above atmospheric. For example, the pressure in the manifold may be approximately 5 mm water guage; for that purpose the manifold may be connected to the outlet of the fan generating suction pressure for the purpose already mentioned.

An example of a machine according to this invention is shown in the accompanying drawings. In the drawings.

Figure 1:
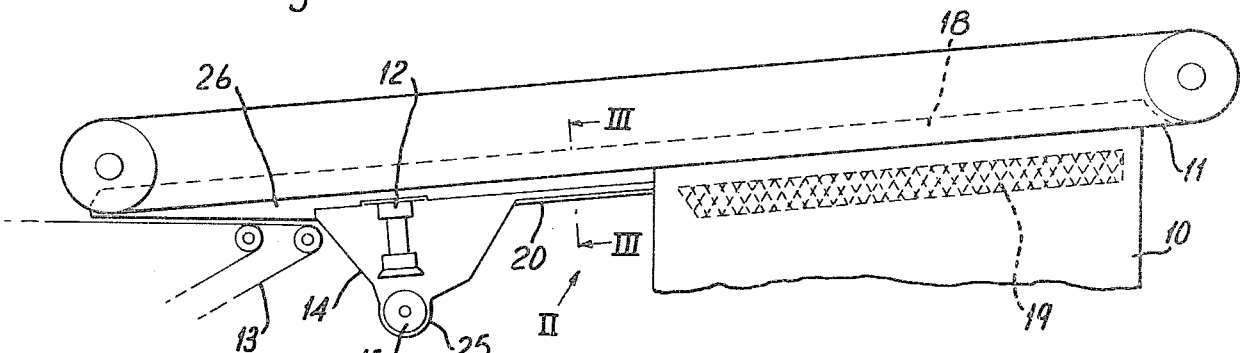
FIG. 1 is a diagrammatic front view of part of the machine.
Figure 2:
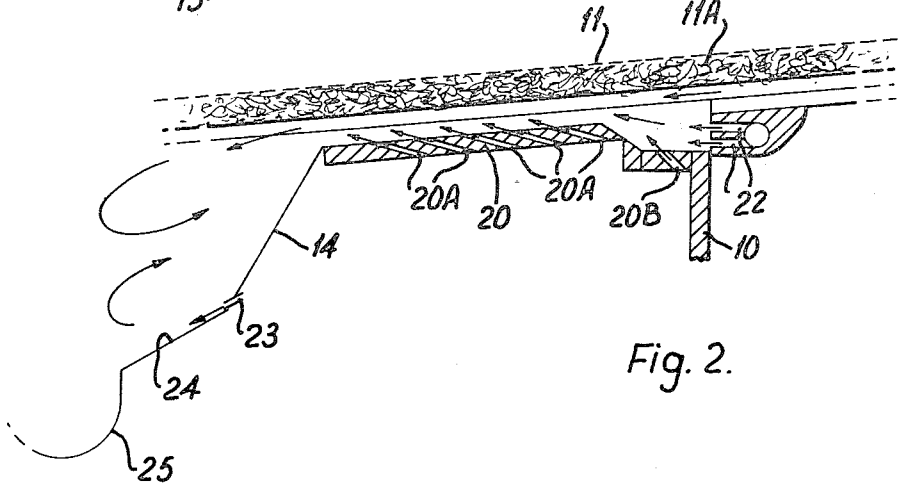
FIG. 2 is an enlarged sectional view of the part of the machine identified by the arrow II in FIG. 1.

As shown in FIG. 1, the machine is basically like a Molins Mark 9 cigarette making machine; details of the machine not shown in the drawings may be similar to those of the Mark 9. It includes a chimney 10 up which tobacco is showered by an upwardly moving air flow towards a suction band 11 on which the tobacco forms a cigarette filler stream 11A. The filler stream is trimmed by a trimming device 12 and is then deposited on a wrapper web 13 in which the stream is enclosed to form a continuous cigarette rod in a well known manner.

Figure 4:
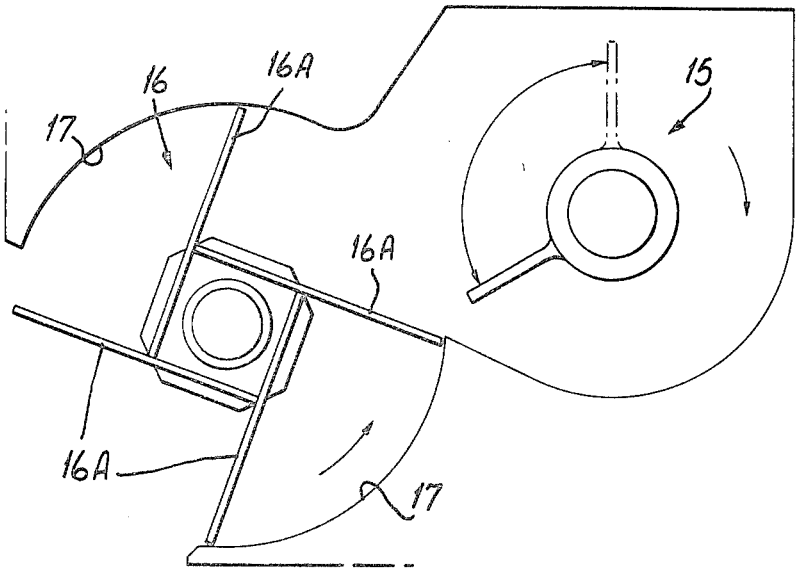
FIG. 4 shows how the discard tobacco is conveyed from the suction enclosure around the trimming device.

The trimming device 12 is contained in a suction enclosure 14. Discard tobacco removed from the filler stream by the trimming device is conveyed transversely by a conveying screw 15 rotating at about 1000 R.P.M. At the downstream end of the screw (see FIG. 4) there is a rotary member 16 which rotates at about ¼ the speed of the screw and lies between part-cylindrical walls 17 defining an outlet from the suction enclosure. The member 16 has paddles or vanes 16A which cooperate with the walls 17 to form an air seal preventing any significant flow of air into the suction enclosure in that area. Angular adjustment of the screw 15 is possible to enable the screw to be set so as to project the tobacco through the rotary member 16 without needing to be conveyed forward by the vanes 16A. After leaving the suction enclosure in this manner, the tobacco may be conveyed by a vibratory tray (not shown) to return it into the hopper of the machine.

As a result of suction which is applied through the suction band 11 from a suction chamber 18, suction pressure is maintained in the enclosure 14. This suction pressure is, however, less than suction pressure at the upper end of the chimney 10 which results partly from the application of suction through a supercharger louvre 19.

Figure 3:
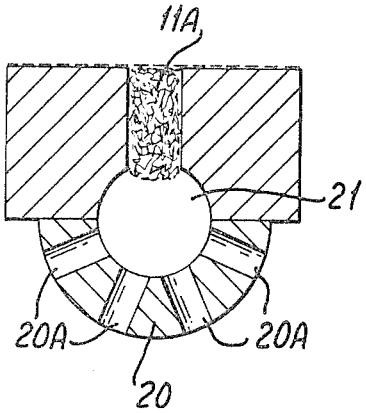
FIG. 3 is a section on the line III—III in FIG. 1.

Between the chimney 10 and the suction enclosure 14, the lower surface of the cigarette filler stream 11A is enclosed in a semi-tubular casing 20 defining a narrow channel 21 (see particularly FIG. 3). Air is admitted into the channel 21 through several inlets which lie obliquely in relation to the direction of movement of the tobacco, stream, so as to produce air jets having components in the direction of movement of the tobacco stream. In particular, the inlets form five groups each comprising four inwardly inclined air inlet bores 20A. In addition there are air inlet bores 20B at the upstream end of the channel 20, and two pairs of forwardly inclined air inlet bores 22 which admit air respectively from the front and back of the chimney 10; when viewed from above, the two pairs of the inlet bores 22 converge approximately towards the centre of the upstream end of the channel 21.

In addition there are a number of air inlets 23 in the suction enclosure 14 to ensure that tobacco landing on the part 24 of the wall of the suction enclosure is swept downwards into a channel 25 containing the screw 15.

Between the edges of the wrapper web 13 and adjacent lower edges of guides 26 confining the sides of the trimmed filler stream 11A there are gaps (e.g. of 0.8 mm) which allow atmospheric air to flow sideways into the suction space below the filler stream at a rate sufficient to ensure that there is substantially no longitudinal air flow along and relative to the filler stream. In other words, the inflow of air through the gaps at each point along the filler stream (in the region of the web 13) approximately equals the air flow upwards through the filler stream 11A and band 11, thus avoiding the production of a longitudinal air flow which could disturb the trimmed filler stream.

I claim:

1. In a cigarette making machine including an air-pervious band, a shower channel through which such air-pervious band passes and in which tobacco is showered towards the band with the aid of an air stream to form a cigarette filler stream on the band, means for inducing the air stream at least partly by suction acting through the band to hold the tobacco against the band, whereby there is also suction pressure in the channel in an area adjacent to the band, the improvement comprising a partly-tubular casing outside said shower channel which covers the cigarette filler stream as it leaves the shower channel, and means including inclined air inlets formed in said casing for inducing air streams into the part-tubular casing in directions having components in the direction of movement of the cigarette filler stream.

2. A cigarette making machine according to claim 1 in which said casing is arranged in communiction with said shower channel so that the inside of the casing has a pressure below atmospheric, with the result that said air inlets draw in air from the atmosphere into said casing.

3. A cigarette making machine according to claim 1 including a trimming device adjacent to the band for trimming the cigarette filler stream, a suction enclosure around the trimming device which is joined to or cooperates with the downstream end of the casing, an outlet from the suction enclosure for delivery of discard tobacco removed from the cigarette filler stream by the trimming device, and a rotary sealing member which allows or promotes movement of discard tobacco through the outlet while substantially preventing any inflow of atmospheric air into the suction enclosure.

4. A cigarette making machine according to claim 3 in which the outlet for tobacco from the suction enclosure is situated at the downstream end of a conveying screw or other conveyor which conveys the discard tobacco from the trimming device.

5. A cigarette making machine according claims 3 or 4, further comprising means including elements which confine the sides of the cigarette filler stream as it approaches a wrapper web and which extend the suction enclosure, said elements forming slight gaps through which atmospheric air can enter the suction enclosure at a rate sufficient to ensure that there is substantially no longitudinal air flow along and relative to the filler stream.

6. A cigarette making machine according to claim 1, wherein said air inlets are provided as groups of angularly-spaced bores in said partly-tubular casing.

* * * * *